US006831503B2

(12) United States Patent
La Rosa

(10) Patent No.: US 6,831,503 B2
(45) Date of Patent: Dec. 14, 2004

(54) CURRENT OR VOLTAGE GENERATOR WITH A TEMPERATURE STABLE OPERATING POINT

(75) Inventor: Francesco La Rosa, Rousset (FR)

(73) Assignee: STMicroelectronics SA, Montrouge (FR)

( * ) Notice: Subject to any disclaimer, the term of this patent is extended or adjusted under 35 U.S.C. 154(b) by 0 days.

(21) Appl. No.: 10/325,609

(22) Filed: Dec. 20, 2002

(65) Prior Publication Data

US 2003/0143796 A1 Jul. 31, 2003

(30) Foreign Application Priority Data

Jan. 17, 2002 (FR) ..... 02 00570

(51) Int. Cl.[7] ..... G05F 1/10
(52) U.S. Cl. ..... 327/541; 327/540; 323/315
(58) Field of Search ..... 327/538, 540, 327/541, 543; 323/313, 315

(56) References Cited

U.S. PATENT DOCUMENTS 5,087,830 A * 2/1992 Cave et al. ..... 327/539
5,483,196 A * 1/1996 Ramet ..... 330/257
5,530,395 A * 6/1996 Ting ..... 327/543
5,576,656 A * 11/1996 McClure ..... 327/538
5,587,655 A 12/1996 Oyabe et al. ..... 323/312
5,739,593 A * 4/1998 Hayama ..... 307/43
5,767,664 A * 6/1998 Price ..... 323/313
5,793,247 A 8/1998 McClure ..... 327/538
5,798,637 A 8/1998 Kim et al. ..... 323/313
6,630,859 B1 * 10/2003 Wang ..... 327/539
6,661,713 B1 * 12/2003 Kuo ..... 365/189.09
2002/0079876 A1 * 6/2002 Eguchi ..... 323/313

* cited by examiner

*Primary Examiner*—Terry D. Cunningham
(74) *Attorney, Agent, or Firm*—Lisa K. Jorgenson; Allen, Dyer, Doppelt, Milbrath & Gilchrist, P.A.

(57) ABSTRACT

A current or voltage generator is integrated onto a silicon wafer and may include a first element including a first NMOS transistor having its source connected to ground through an electrical resistance, a second element including a second NMOS transistor having its source connected to ground, and a bias circuit for the first and second elements. The second element may include a voltage divider. The gate of the second NMOS transistor may be connected to a dividing node of the voltage divider, and the anode of the voltage divider may be connected to the gate of the first NMOS transistor. Both elements may be biased at an operating point corresponding to an identical temperature stability point for both elements.

28 Claims, 7 Drawing Sheets

CURRENT OR VOLTAGE GENERATOR WITH A TEMPERATURE STABLE OPERATING POINT

FIELD OF THE INVENTION

The present invention relates to integrated circuits, and, more particularly to a current or voltage generator integrated onto a silicon wafer.

BACKGROUND OF THE INVENTION

A current or voltage generator 10 of the above-mentioned type is represented in FIG. 1. The circuit 10 comprises two branches B1 and B2. The branch B1 comprises a PMOS transistor TP1 the drain of which is connected to the drain of an NMOS transistor TN1, the source of the transistor TN1 being connected to ground through a resistance R1. The branch B2 comprises a PMOS transistor TP2, the drain of which is connected to the drain of an NMOS transistor TN2, and the source of the transistor TN2 is connected to ground. The transistor TN1 has a gate width to length ratio, or W/L ratio, equal to n times that of the transistor TN2, and is generally produced by n NMOS transistors TN1-1, TN1-2, . . . TN1-n in parallel, that are identical to the transistor TN2. The transistors TP1, TP2 receive a voltage Vcc on sources S and are arranged as current mirrors, with the gate G of the transistor TP2 being connected to the gate of the transistor TP1 which is itself connected to the drain D of the transistor TP1.

So that the circuit 10 self-biases at a determined operating point, the gate of the transistor TN1 is connected to the gate of the transistor TN2 which is itself connected to the drain of the transistor TN2. After application of the voltage Vcc, the generator 10 sets to an operating point where the branches B1, B2 are passed through by the same current I, taken to be constant.

The generator 10 delivers a reference voltage Vref that is, for example, sampled at the gate of the transistor TN1. To obtain a constant source of current, the voltage Vref is applied to the gate of an NMOS transistor TN0 arranged in an external branch Be. The voltage Vref imposes a current Ie(Vref) in the branch Be. This current is equal to the current I if the transistor TN0 is identical to the transistor TN1, otherwise it is proportional to the current I. The transistor TN0 is therefore the equivalent of a current generator inserted into the branch Be. Other current generators can be created in this way by applying the voltage Vref to other transistors.

The current or voltage generator that has just been described provides the advantage of being very simple and small in size in terms of silicon surface. However, it is inconvenient in that it is sensitive to temperature variations, and to variations in the supply voltage Vcc. For a better understanding, FIG. 2 represents current Ie(Vref) curves according to the temperature T and to the voltage Vcc. It can be seen that the current Ie(Vref) varies with the temperature, for a given supply voltage Vcc. Furthermore, for a given temperature T, it can also be seen that the current increases when the voltage Vcc increases.

SUMMARY OF THE INVENTION

The purpose of the present invention is to overcome this shortcoming in a simple manner, without using complex stabilization circuits.

More particularly, the purpose of the present invention is to provide a current or voltage generator of the aforementioned type that has good temperature stability.

The purpose of the present invention is also to provide a current or voltage generator of the afore-mentioned type that remains stable when its supply voltage varies.

For these purposes, the present invention provides a generator comprising two elements that can have identical temperature stability points. More particularly, the present invention provides a current or voltage generator integrated onto a silicon wafer, comprising a first element comprising a first NMOS transistor having its source connected to ground through an electrical resistance, and a second element comprising a second NMOS transistor having its source connected to ground. The generator may also include a bias circuit for the first and second elements. The second element may comprise a voltage divider, the gate of the second NMOS transistor may be connected to a dividing node of the voltage divider, and the anode of the voltage divider may be connected to the gate of the first NMOS transistor.

According to one embodiment, the voltage divider comprises at least two resistances, and the gate of the second NMOS transistor is connected to the midpoint of the two resistances.

According to one embodiment, the bias circuit applies an identical drain-source current to the first and second elements, such that the first and second elements have a common operating point in current and in voltage.

According to one embodiment, the first and second elements are arranged to have the same temperature stability point, i.e. current/voltage curves according to the temperature of each element that meet at the same point.

According to one embodiment, the bias circuit is arranged so that the common operating point of the first and second elements corresponds to the temperature stability point of the first and second elements.

According to one embodiment, the bias circuit comprises a first branch connected to the drain of the first NMOS transistor, a second branch connected to the drain of the second NMOS transistor, and a third branch connected to the anode of the divider. The first branch and the second branch may be arranged as current mirrors.

According to one embodiment, the first branch and the second branch respectively may comprise a first PMOS transistor and a second PMOS transistor.

According to one embodiment, the first branch may comprise a third NMOS transistor arranged between the first PMOS transistor and the first NMOS transistor, the second branch may comprise a fourth NMOS transistor arranged between the second PMOS transistor and the second NMOS transistor, and the third branch may comprise a fifth NMOS transistor having its gate connected to those of the third and fourth NMOS transistors.

According to one embodiment, the bias circuit comprises a fourth branch comprising a third PMOS transistor in series with a sixth NMOS transistor. The third PMOS transistor and the sixth NMOS transistor may be arranged to maintain a voltage on the drain of the first PMOS transistor that is substantially identical to the drain voltage of the second PMOS transistor.

According to one embodiment, the gate of the third PMOS transistor may be connected to the drain of the first PMOS transistor, and the gate of the sixth NMOS transistor may be connected to the gate of the second NMOS transistor.

According to one embodiment, the second PMOS transistor may have its drain connected to its gate and its gate connected to the gate of the first PMOS transistor.

According to one embodiment, the first NMOS transistor may comprise a plurality of NMOS transistors in parallel.

According to one embodiment, the generator may comprise an output delivering a reference voltage equal to the gate voltage of the first NMOS transistor.

According to one embodiment, the generator may comprise an output delivering a reference voltage equal to the gate voltage of the second NMOS transistor.

According to one embodiment, at least one gate of the first or second NMOS transistor may be connected to the gate of a transistor arranged in an external branch to form a source of current.

BRIEF DESCRIPTION OF THE DRAWINGS

These and other objects, features and advantages of the present invention will be explained in greater detail in the following description of a current or voltage generator according to the present invention, given in relation with, but not limited to, the following figures.

DETAILED DESCRIPTION OF THE PREFERRED EMBODIMENTS

Figure 1:
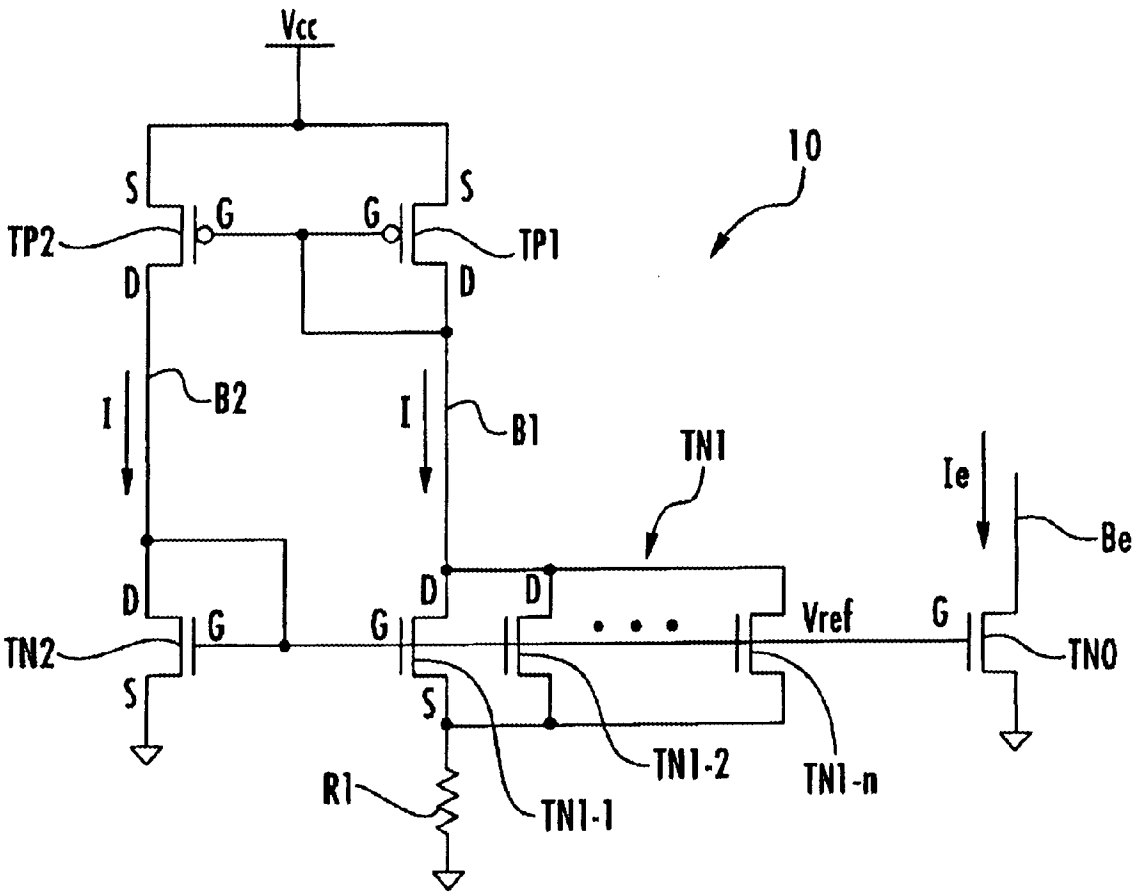
FIG. 1 (PRIOR ART)
FIG. 1 previously described is the wiring diagram of a classical current or voltage generator according to the prior art.
Figure 3A:
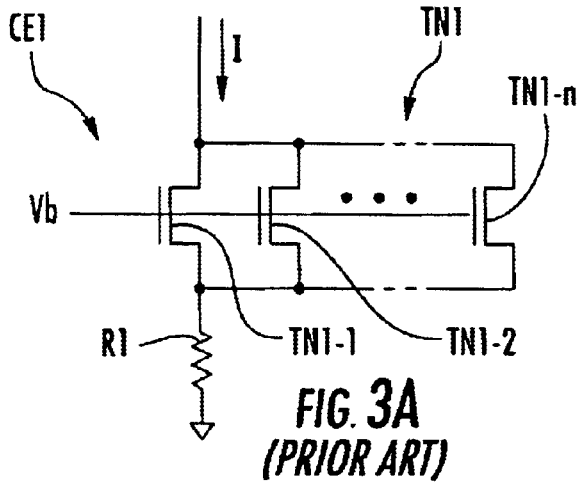
FIG. 3A (PRIOR ART)
FIG. 3A represents a first element of the generator in FIG. 1.
Figure 3B:
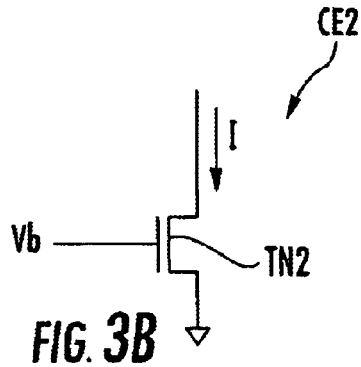
FIG. 3B (PRIOR ART)
FIG. 3B represents a second element of the generator in FIG. 1.

FIGS. 3A, 3B illustrate two elements CE1, CE2 forming the core of the generator 10 described in the background (FIG. 1). The element CE1 comprises the transistor TN1 and the resistance R1. The transistor TN1 has its source connected to ground via the resistance R1, and its gate receives a bias voltage Vb. The transistor TN1 is passed through by a drain-source current I. The element CE2 comprises the transistor TN2 that receives the bias voltage Vb at its gate and is passed through by the same drain-source current I.

Figure 4:
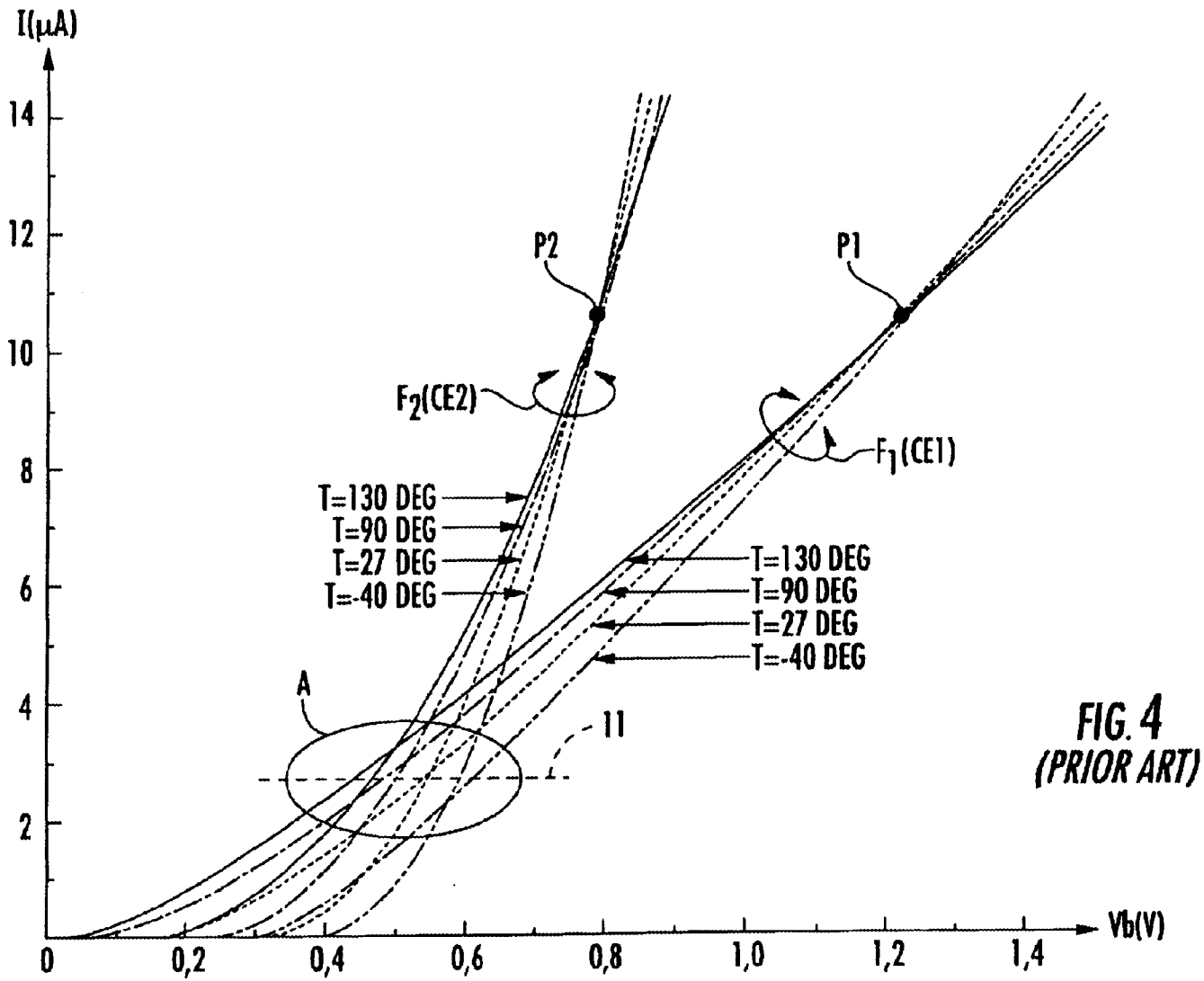
FIG. 4 (PRIOR ART)
FIG. 4 represents series of current/voltage curves of the prior art elements represented in FIGS. 3A and 3B.

FIG. 4 represents current/voltage curves of each of the elements CE1, CE2. A series of curves F1(CE1) can be seen comprising current/voltage curves of the element CE1 at various temperatures, here at temperatures of −40, 27, 90, and 130° C. A series of curves F2(CE2) can also be seen comprising current/voltage curves of the element CE2 at various temperatures, here −40, 27, 90, and 130° C. Each current/voltage curve represents the relationship that exists between the bias voltage Vb (on the abscissa and in Volts) and the drain-source current (on the ordinate and in $\mu$A) when the transistors are operating in a saturated mode.

Figure 2:
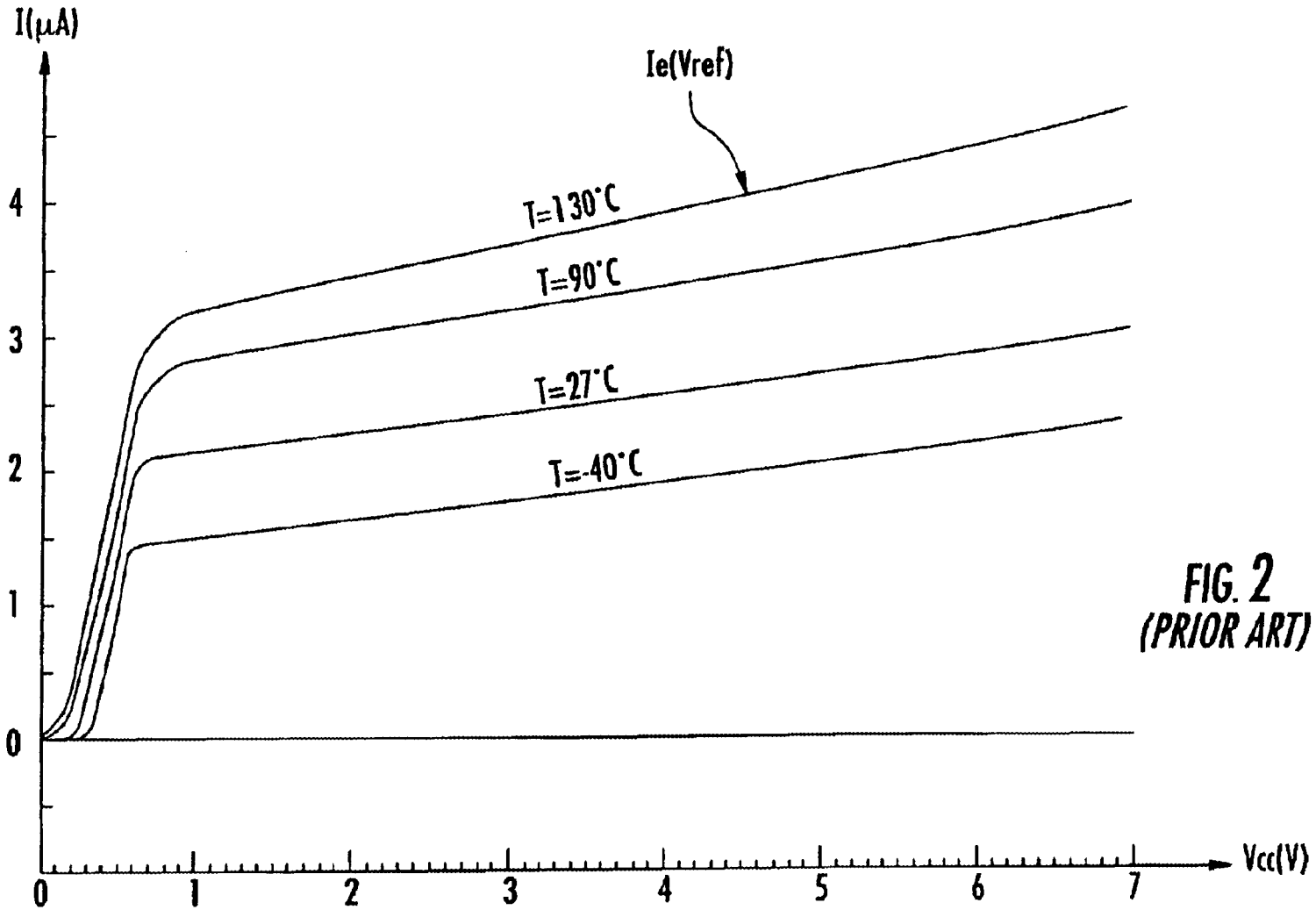
FIG. 2 (PRIOR ART)
FIG. 2 previously described shows the instability in temperature of a current produced by the generator in FIG. 1.

When the elements CE1, CE2 are arranged in the generator 10, they have a common operating point imposed by the transistors TP1, TP2. This common operating point is located, for a given temperature, where the two curves belonging respectively to the series F1 and to the series F2 meet, in a zone A where the current/voltage curves of the two elements meet, proximate to a horizontal line 11. When the temperature varies, the operating point can move horizontally along the line 11 or vertically about the line 11. In other terms, the bias voltage Vb varies with the temperature and the generator 10 has an operating point that is not constant in current and in voltage. The jumps of the operating point from one curve to the other affect the stability of the current I, and that of the external current Ie(Vref) which is the image of the current I, as shown in FIG. 2.

The present invention is based on the observation according to which the curves of the series of curves F1, F2 have a common meeting point, respectively P1, P2 in FIG. 4. The point P1 constitutes a temperature stability point of the element CE1 as all the current/voltage curves of the element CE1 have, at this point, the same voltage and the same current. For the same reason, the point P2 represents a temperature stability point of the element CE2.

Therefore, one aspect of the present invention is to provide two elements that have the same temperature stability point, and to set these elements to a common operating point corresponding to their temperature stability point. However, as it will be understood by those skilled in the art, in practice, it is difficult to move the stability point P2 of the element CE2 so that it coincides with the stability point P1 of the element CE1. There is a small degree of freedom in the design of the transistor TN2, which does not allow the points P1 and P2 to be superimposed.

Figure 3C:
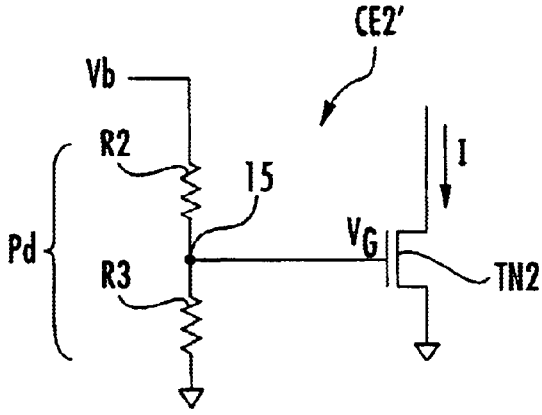
FIG. 3C represents an element according to the present invention.

The present invention suggests producing a current or voltage generator using a first element CE1 conforming to the one represented in FIG. 3A and a second element CE2' represented in FIG. 3C, which replaces the conventional element CE2 represented in FIG. 3B. The element CE2' comprises the NMOS transistor TN1 already present in the element CE2 and comprises, in addition, a voltage divider Pd. The divider comprises for example two resistances R2, R3. One end of the resistance R2 forms the anode of the divider Pd, the other end of the resistance R2 is connected to one end of the resistance R3, the other end of the resistance R3 is connected to ground. According to the present invention, the gate of the transistor TN1 is connected to a dividing node 15 of the divider Pd, here the midpoint of the resistances R2, R3, and thus receives a gate voltage Vg which is a fraction of the voltage applied between the anode of the divider and the ground.

Figure 5:
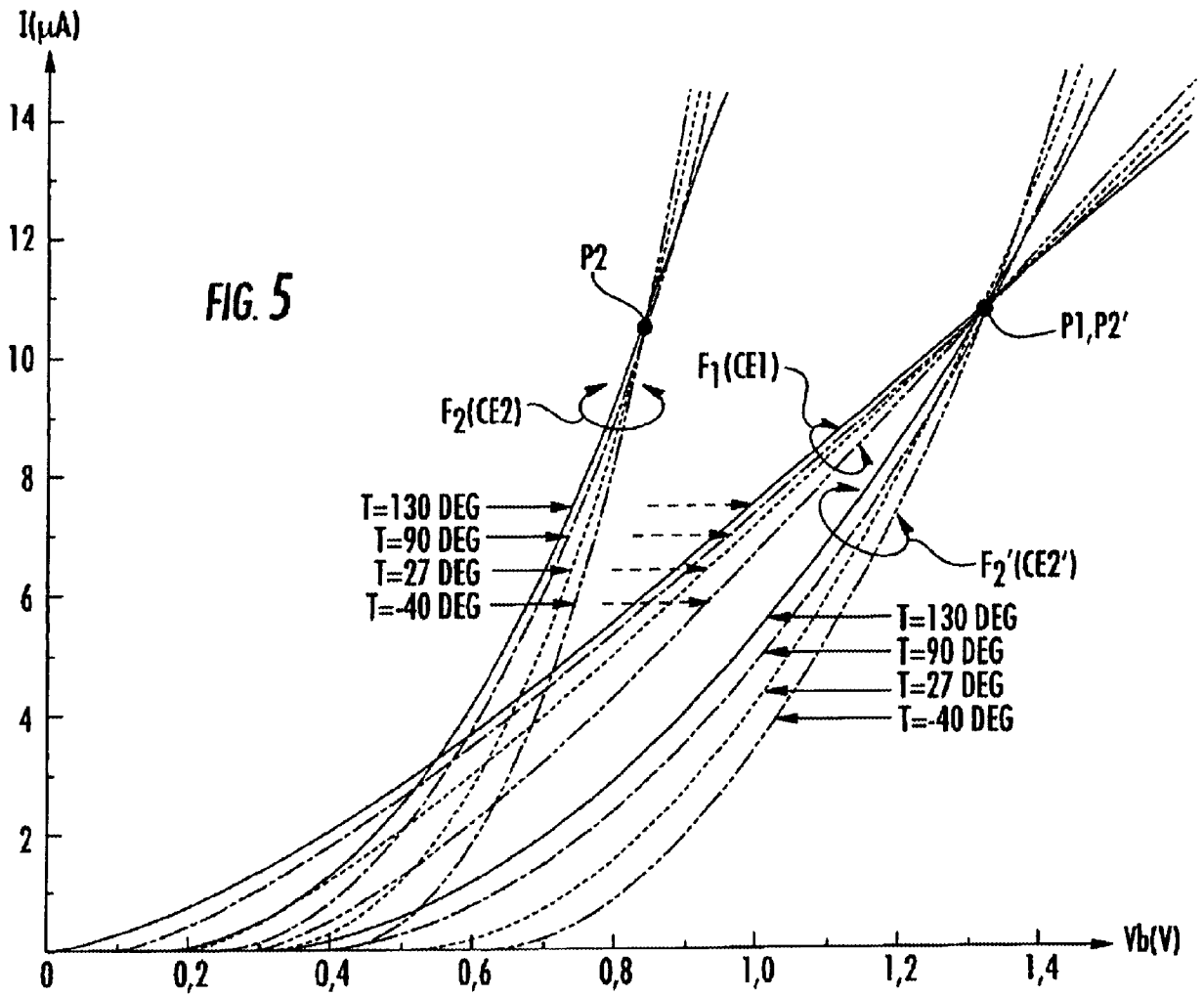
FIG. 5 represents the series of curves in FIG. 4 and one series of current/voltage curves of the element represented in FIG. 3C.

FIG. 5 represents the series of curves F1(CE1), F2(CE2) already represented in FIG. 4, and a series of current/voltage curves F2'(CE2') of the element CE2'. The series F2'(CE2') here comprises four curves traced at the same temperatures as the series F1, F2. These curves have been traced by considering that the voltage applied to the divider Pd is the bias voltage Vb of the element CE2'. It can be seen that the series F2' also has a temperature stability point P2', where all the curves meet. Furthermore, thanks to the possibility of adjusting the ratio Vg/Vb between the gate voltage Vg of the transistor TN1 and the bias voltage Vb, it is possible to make the element CE2' have a stability point P2' that merges with the stability point P1 of the element CE1, as shown in FIG. 5.

Figure 6:
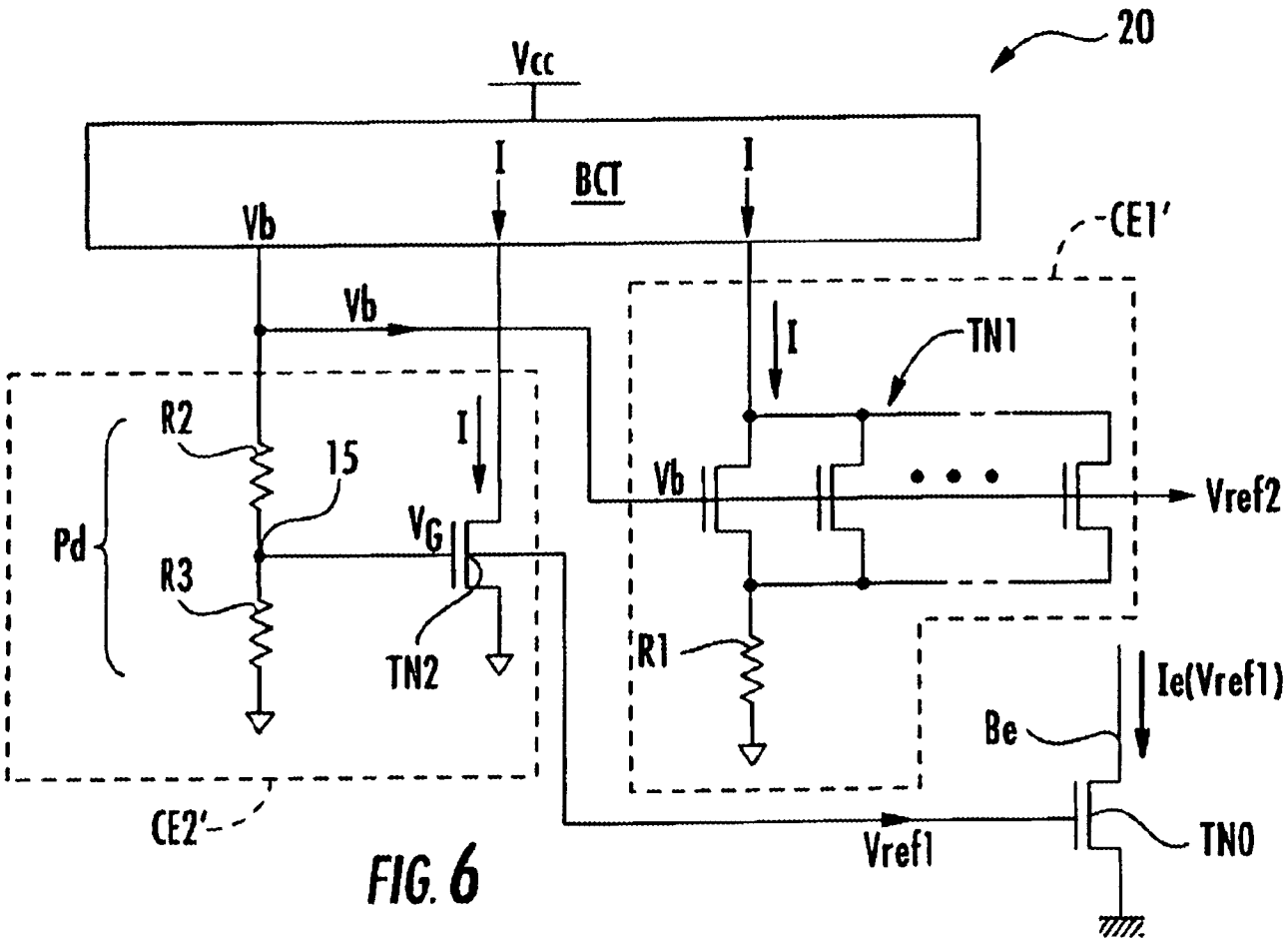
FIG. 6 is the schematic diagram of a current or voltage generator according to the present invention.

FIG. 6 represents a current or voltage generator 20 according to the present invention, produced using the element CE1 and the element CE2'. The size of the transistors TN1 and TN2 and the value of the resistances R1, R2, R3 are chosen so that the elements CE1, CE2' have identical stability points P1, P2', as shown in FIG. 5. A bias circuit BCT supplied by a voltage Vcc imposes the same drain-source current I in each element CE1, CE2', and applies a bias voltage Vb to the anode of the divider Pd.

According to the present invention, the anode of the divider Pd is connected to the gate of the transistor TN1 of the element CE1, so that both elements receive the same bias voltage Vb. The current I and the voltage Vb define the common operating point of the elements CE1, CE2', which corresponds to the stability points P1, P2'. The generator 20 therefore has excellent stability in temperature, its operating point I, Vb corresponding to the temperature stability point of the elements CE1, CE2'.

As represented in FIG. 6, the generator 20 can deliver two reference voltages. One reference voltage Vref1 can be sampled on the gate of the transistor TN2 and be applied to an NMOS transistor TN0 arranged in an external branch Be, to form a constant source of current. The voltage Vref1 allows a constant current Ie that is equal to the current I if the transistor TN0 has the same dimensions as the transistor TN1 (same gate width to length ratio) to be imposed in the transistor TN0, by a current mirror effect. Furthermore as the voltage Vref1 is a constant voltage, the gate of the transistor TN2 can be used as a constant voltage generator.

A reference voltage Vref2 can also be sampled on the gate of the transistor TN1 (or on the anode of the divider Pd). This voltage Vref2 is the bias voltage Vb and corresponds to the temperature stability point. The voltage Vref2 is also constant and the gate of the transistor TN1 can be used as a constant voltage generator.

Figure 7:
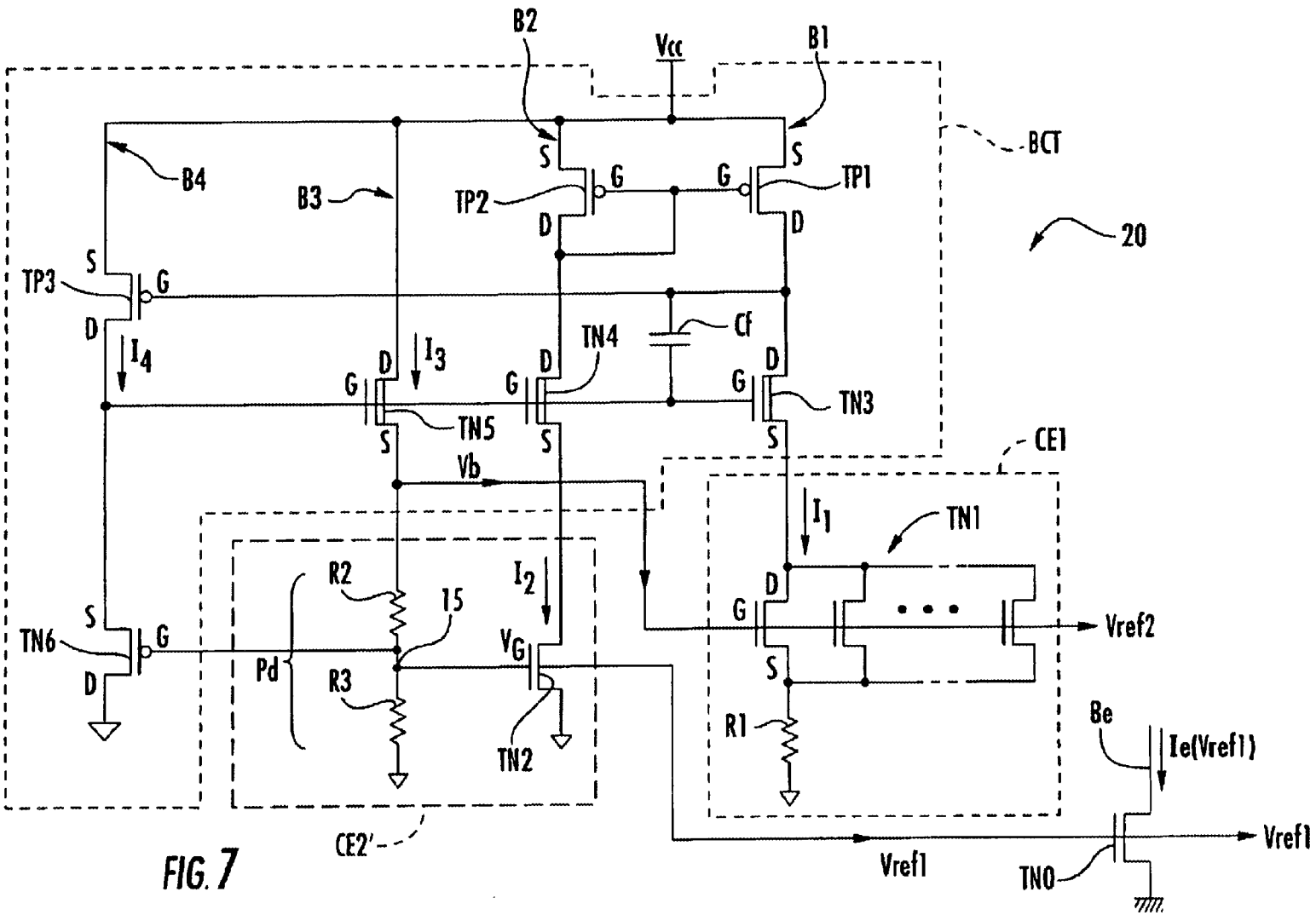
FIG. 7 is the complete wiring diagram of an example of an embodiment of a current or voltage generator according to the present invention.

An example of an embodiment of the bias circuit BCT will now be described in relation with FIG. 7. One intended object is to bias the elements CE1 and CE2' on the operating point I, Vb corresponding to their temperature stability point. Another intended object here is that the operating point I, Vb is not substantially sensitive to any variations in the supply voltage Vcc.

The circuit BCT comprises a branch B1 connected to the element CE1, branches B2 and B3 connected to the element CE2', and a negative feedback branch B4. The branch B1 comprises a PMOS transistor TP1 and an NMOS transistor TN3 in series. The branch B2 comprises a PMOS transistor TP2 and an NMOS transistor TN4 in series. The transistor TP1 receives the voltage Vcc at its source and its drain is connected to the drain of the transistor TN3. The source of the transistor TN3 is connected to the drain of the transistor TN1 of the element CE1, the source of which is connected to ground via the resistance R1. The transistor TP2 receives the voltage Vcc at its source and its drain is connected to the drain of the transistor TN4. The source of the transistor TN4 is connected to the drain of the transistor TN2 of the element CE2', the source of which is connected to ground. The gates of the transistors TP1 and TP2 are interconnected, and the transistor TP2 has, in addition, its gate connected to its drain. The gates of the transistors TN3, TN4 are also interconnected.

The branch B3 comprises an NMOS transistor TN5 the drain of which receives the voltage Vcc and the source of which is connected to the anode of the divider Pd of the element CE2', here the end of the resistance R2. The gate of the transistor TN5 is connected to the gates of the transistors TN3, TN4. The anode of the divider Pd is also connected to the gate of the transistor TN1, as described above.

The branch B4 comprises a PMOS transistor TP3 and an NMOS transistor TN6 in series. The transistor TP3 receives the voltage Vcc at its source and its drain is connected to the drain of the transistor TN6, the source of which is connected to ground. The gate of the transistor TN6 is connected to the gate of the transistor TN2 of the element CE2' (midpoint 15 of the resistances R2, R3) and the gate of the transistor TP3 is connected to the drain of the transistor TP1. Optionally, but advantageously, an anti-oscillation capacitor Cf is arranged between the gate of the transistor TP3 and the gate of the transistor TN3.

Preferably, the transistors TP1, TP2 and TP3 are identical (same gate width to length ratio), the transistors TN2, TN6 are identical. The transistor TN1 also preferably comprises n transistors identical to the transistor TN2 and therefore has a W/L ratio that is equal to n times the W/L ratio of the transistor TN2. Again preferably, the transistors TN3, TN4, TN5 are identical and have a low threshold voltage, below that of the transistors TN1, TN2. The transistors TN3, TN4, TN5 are for example native transistors (with undoped channels) having a threshold voltage in the order of 0.4 V, compared to 1 V for those of the transistors TN1, TN2, that are conventional enhancement transistors.

The branches Bi and B2 are arranged as current mirrors and are passed through by currents I1 and I2 that aim to be equal to the drain-source current I required. The transistor TN5 in the branch B3 is arranged as a follower and aims to impose a current I3 in the divider Pd, so that the bias voltage Vb at the operating point is equal to I3*(R2+R3) and that the gate voltage of the transistor TN2 is equal to I3*R3 (or Vb*R3/R2+R3). As indicated above, the current I3 is chosen to correspond to the current of the temperature stability point of the elements CE1, CE2' and the resistances R2 and R3 are chosen so that the voltage Vd corresponds to the voltage of the temperature stability point.

The branch B4 ensures the self-bias of the generator 20 at the operating point I, Vb. As an example, it will be assumed that the voltage Vb is higher than the voltage of the theoretical operating point. In this case, by observing FIG. 5, it can be seen that the current of the operating point on the series of curves CE2' is higher than the current of the operating point on the series of curves CE1. In this case, the gate voltage of the transistor TP3 increases and the voltage Vb drops as the transistor TP3 conducts less current. If, on the other hand, the voltage Vb becomes lower than that of the theoretical operating point, the current of the series of curves CE2' becomes lower than the current of the series of curves CE1 and the gate voltage of the transistor TP3 drops, so that the voltage Vb increases. Consequently, thanks to the branch B4, the generator according to the present invention always reacts in such a way as to bring the current back to the nominal value of the operating point.

Therefore, the branches B1, B2, B3, B4 are passed through by the same current and the transistor TP3 imposes a drain voltage on the transistor TP1 that is identical to the drain voltage of the transistor TP2. As the transistors TP1, TP2 receive the same voltage Vcc at their source, the drain-source voltages of these two transistors are checked and are maintained identical. If the voltage Vcc varies and becomes high, the transistors TN1, TN2 are capable of not having the same drain current variation for the same drain voltage variation, as they are not identical, which could unbalance the generator 20. The transistors TN3, TN4 correct this phenomenon and maintain a constant drain voltage on the transistors TN1, TN2. In fact, the variations in the voltage Vcc affect the drain-source voltage of the transistors TN3, TN4 but, as these are identical and biased in the same conditions, the variations of the voltage Vcc do not cause any shift of the operating point.

The current or voltage generator according to the present invention delivers a current I (Vref1) or voltages Vref1 and Vref2 that have great temperature stability. As a numerical example, for a voltage Vcc of 1.85 V and a temperature varying between −40° C. and 130° C., and for the following nominal values:

$$Vref1=0.8V$$

$$I(Vref1)\ (=I)=10.45\mu A$$

$$Vref2=1.235V$$

the measurable variations are as follows:

$$0.797V<Vref1<0.804V$$

$$10.4\mu A<I(Vref1)\ (=I)<10.5\mu A$$

$$1.23V<Vref2<1.24V$$

and are therefore below ±0.5% over the whole range of temperatures.

What is claimed is:

1. An integrated current or voltage generator comprising:

a first element comprising an electrical resistance, and a first NMOS transistor having a source connected to a voltage reference through said electrical resistance;

a second element comprising a second NMOS transistor having a source connected to the voltage reference; and a bias circuit for said first and second elements;

said second element further comprising a voltage divider having a dividing node connected to a gate of said second NMOS transistor and a terminal connected to a gate of said first NMOS transistor; and said bias circuit comprising a first branch connected to a drain of said first NMOS transistor, a second branch connected to a drain of said second NMOS transistor, and a third branch connected to the anode of said divider, said first and second branches being arranged as current mirrors.

2. A generator according to claim 1 wherein said voltage divider comprises two resistances with the dividing node therebetween.

3. A generator according to claim 1 wherein said bias circuit applies an identical drain-source current to said first and second elements, such that the first and second elements have a common operating point in current and in voltage.

4. A generator according to claim 3 wherein said first and second elements are arranged to have a same temperature stability point.

5. A generator according to claim 4 wherein said bias circuit is arranged so that the common operating point corresponds to the temperature stability point.

6. A generator according to claim 1 wherein said first branch and said second branch respectively comprise a first PMOS transistor and a second PMOS transistor.

7. A generator according to claim 6 wherein said first branch comprises a third NMOS transistor arranged between said first PMOS transistor and said first NMOS transistor; wherein said second branch comprises a fourth NMOS transistor arranged between said second PMOS transistor and said second NMOS transistor; and wherein said third branch comprises a fifth NMOS transistor having a gate connected to gates of said third and fourth NMOS transistors.

8. A generator according to claim 7 wherein said bias circuit comprises a fourth branch comprising a third PMOS transistor in series with a sixth NMOS transistor; wherein said third PMOS transistor and said sixth NMOS transistor being arranged to maintain a voltage on the drain of said first PMOS transistor that is substantially identical to a drain voltage of said second PMOS transistor.

9. A generator according to claim 8 wherein the gate of said third PMOS transistor is connected to the drain of said first PMOS transistor; and wherein the gate of said sixth NMOS transistor is connected to the gate of said second NMOS transistor.

10. A generator according to claim 9 wherein said second PMOS transistor has a drain connected to a gate thereof; and wherein the gate of said second PMOS transistor is also connected to the gate of said first PMOS transistor.

11. A generator according to claim 1 further comprising at least one additional NMOS transistor connected in parallel with said first NMOS transistor.

12. A generator according to claim 1 further comprising an output delivering a first output voltage equal to a gate voltage of said first NMOS transistor.

13. A generator according to claim 12 further comprising an output delivering a second output voltage equal to a gate voltage of said second NMOS transistor.

14. A generator according to claim 13 further comprising an external branch comprising an external transistor; and wherein at least one gate of said first and second NMOS transistors is connected to the gate of the external transistor to form a source of current.

15. An integrated current or voltage generator comprising:

a first element comprising an electrical resistance, and a first MOS transistor having a conduction terminal connected to a voltage reference through said electrical resistance;

a second element comprising a second MOS transistor having a conduction terminal connected to the voltage reference; and a bias circuit for said first and second elements; said second element further comprising a voltage divider having a dividing node connected to a gate of said second MOS transistor and a terminal connected to a gate of said first NMOS transistor; and said bias circuit comprising a first branch connected to a conduction terminal of said first MOS transistor;

a second branch connected to a conduction terminal of said second MOS transistor; and a third branch connected to the terminal of said divider; said first and second branches being arranged as current mirrors.

16. A generator according to claim 15 wherein said voltage divider comprises two resistances with the dividing node therebetween.

17. A generator according to claim 15 wherein said bias circuit applies an identical current to said first and second elements, such that the first and second elements have a common operating point in current and in voltage.

18. A generator according to claim 15 wherein said first and second elements are arranged to have a same temperature stability point.

19. A generator according to claim 18 wherein said bias circuit is arranged so that the common operating point corresponds to the temperature stability point.

20. A generator according to claim 15 further comprising at least one additional NMOS transistor connected in parallel with said first NMOS transistor.

21. A generator according to claim 15 further comprising an output delivering a first output voltage equal to a gate voltage of said first MOS transistor.

22. A generator according to claim 21 further comprising an output delivering a second output voltage equal to a gate voltage of said second MOS transistor.

23. A generator according to claim 22 further comprising an external branch, comprising an external transistor; and wherein at least one gate of said first and second MOS transistors is connected to the gate of the external transistor to form a source of current.

24. A method for generating a current or voltage using a first element comprising an electrical resistance, and a first MOB transistor having a conduction terminal connected to a voltage reference through the electrical resistance; and a second element comprising a second MOS transistor having a conduction terminal connected to the voltage reference; the method comprising:

biasing the first and second elements with a biasing circuit having first, second and third branches, the first and second branches being arranged as current mirrors;

connecting a dividing node of a voltage divider to a gate of the second MOS transistor and connecting a terminal of the voltage divider to a gate of the first NMOS transistor;

connecting the first branch to a conduction terminal of the first MOS transistor;

connecting the second branch a conduction terminal of the second MOS transistor; and connecting the third branch to the terminal of the divider.

25. A method according to claim 24 wherein the voltage divider comprises two resistances with the dividing node therebetween.

26. A method according to claim 24 wherein the first and second elements are arranged to have a same temperature stability point.

27. A method according to claim 24 wherein biasing comprises biasing so that the common operating point corresponds to the temperature stability point.

28. A method according to claim 24 wherein biasing comprises applying an identical current to the first and second elements, such that the first and second elements have a common operating point in current and in voltage.

* * * * *

UNITED STATES PATENT AND TRADEMARK OFFICE

CERTIFICATE OF CORRECTION

PATENT NO. : 6,831,503 B2
DATED : December 14, 2004
INVENTOR(S) : La Rosa

It is certified that error appears in the above-identified patent and that said Letters Patent is hereby corrected as shown below:

Column 6,
Line 24, delete "bi" insert -- B1 --.

Column 8,
Line 39-40, delete "second elements; said second" insert -- second elements; said second --

Column 9,
Line 8, delete "branch, comprising" insert -- branch comprising --

Column 8,
Line 15, delete "MOB" insert -- MOS --

Signed and Sealed this

Fourteenth Day of June, 2005

JON W. DUDAS
*Director of the United States Patent and Trademark Office*

UNITED STATES PATENT AND TRADEMARK OFFICE

CERTIFICATE OF CORRECTION

PATENT NO. : 6,831,503 B2
DATED : December 14, 2004
INVENTOR(S) : La Rosa

It is certified that error appears in the above-identified patent and that said Letters Patent is hereby corrected as shown below:

Column 6,
Line 24, delete "Bi" insert -- B1 --.

Column 8,
Lines 39-40, delete "second elements; said second" insert -- second elements; said second --.

Column 9,
Line 8, delete "branch, comprising" insert -- branch comprising --.

Column 8,
Line 15, delete "MOB" insert -- MOS --.

Signed and Sealed this

Twenty-second Day of November, 2005

JON W. DUDAS
*Director of the United States Patent and Trademark Office*